US005597002A

United States Patent [19]

Stanley, Jr. et al.

[11] Patent Number: 5,597,002

[45] Date of Patent: Jan. 28, 1997

[54] ROLLER SPINNING TOOL

[76] Inventors: Ronald D. Stanley, Jr.; Carla M. Schauer; Jim K. Schauer, all of P.O. Box 192, Running Springs, Calif. 92382

[21] Appl. No.: 503,504

[22] Filed: Jul. 18, 1995

[51] Int. Cl.[6] ..... B08B 3/04

[52] U.S. Cl. ..... 134/149; 134/900

[58] Field of Search ..... 134/149, 900; 15/145, 230.11; 366/129, 276, 343; 99/419; 294/61; 492/13, 14, 19; 242/588, 588.2, 130.4; 68/198; 248/309.2

[56] References Cited

U.S. PATENT DOCUMENTS

| | | | |
|---|---|---|---|
| 408,668 | 8/1889 | Peck | 68/198 |
| 447,800 | 3/1891 | Walker | 242/130.4 |
| 2,589,545 | 3/1952 | Harvey | 242/130.4 |
| 2,616,281 | 11/1952 | Calhoun | 134/900 X |

FOREIGN PATENT DOCUMENTS

| | | | |
|---|---|---|---|
| 3636173 | 5/1988 | Germany | 366/129 |
| 907870 | 10/1962 | United Kingdom | 242/130.4 |

*Primary Examiner*—Philip R. Coe

[57] ABSTRACT

A tool for effecting rotating of a paint roller to clean and condition the roller. The inventive devices includes a handle member for coupling to a brush spinner or for manual rotation between opposed palms of a pair of human hands. A central engaging member extends from the handle member for engaging a center of a roller to permit rotation thereof within a solvent.

1 Claim, 3 Drawing Sheets

FIG 1
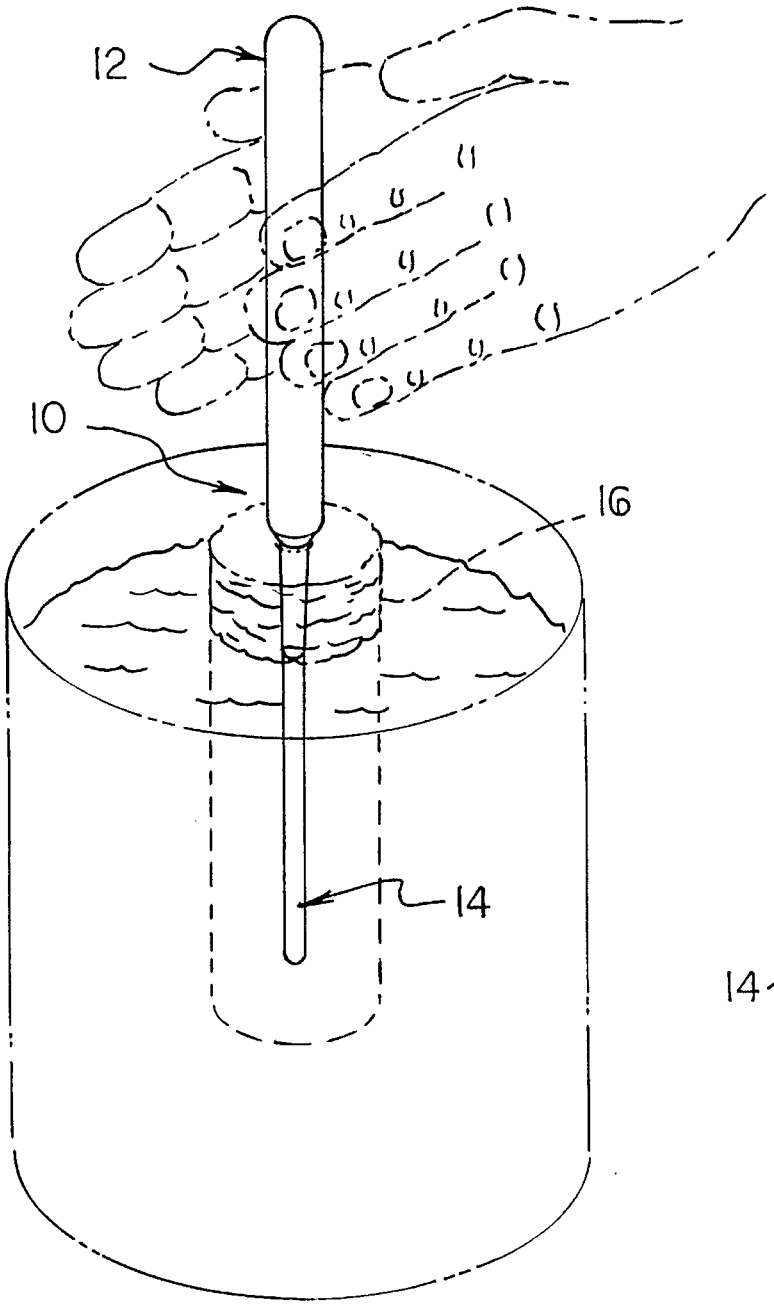
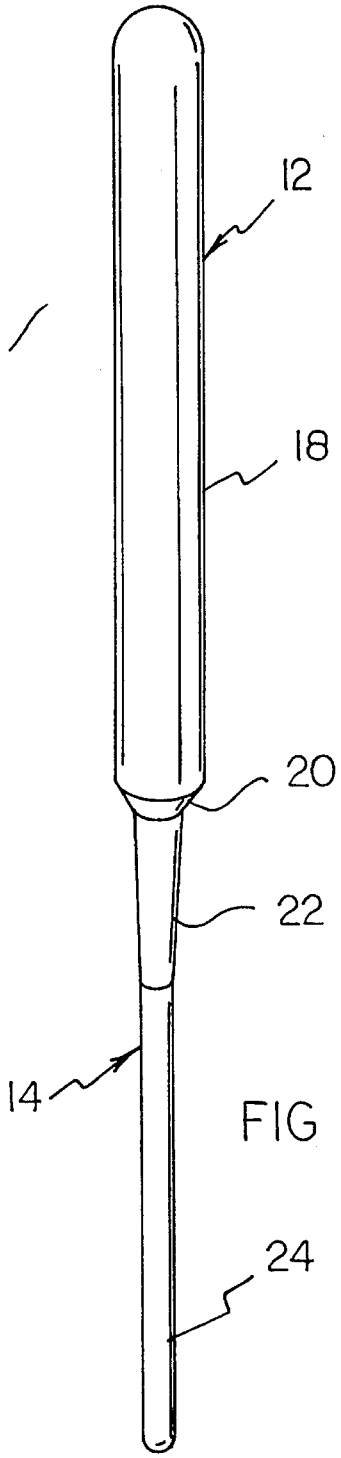
FIG 2

ROLLER SPINNING TOOL

BACKGROUND OF THE INVENTION

1. Field of the Invention

The present invention relates to rotating implements and more particularly pertains to a roller spinning tool for effecting rotation of a paint roller to clean and condition the roller.

2. Description of the Prior Art

The use of rotating implements is known in the prior art. More specifically, rotating implements heretofore devised and utilized are known to consist basically of familiar, expected and obvious structural configurations, notwithstanding the myriad of designs encompassed by the crowded prior art which have been developed for the fulfillment of countless objectives and requirements.

Known prior art rotating implements include U.S. Pat. No. 5,185,938; U.S. Pat. No. 5,095,928; U.S. Pat. No. 5,050,626; U.S. Pat. No. 5,345,648; U.S. Pat. No. Des. 298,912; U.S. Pat. No. Des. 265,940; U.S. Pat. No. Des. 330,101.

While these devices fulfill their respective, particular objectives and requirements, the aforementioned patents do not disclose a roller spinning tool for effecting rotating of a paint roller to clean and condition the roller which includes a handle member for coupling to a brush spinner for manual rotation between opposed palms of a pair of human hands, and a central engaging member extending from the handle member for engaging a center of a roller to permit rotation thereof within a solvent.

In these respects, the roller spinning tool according to the present invention substantially departs from the conventional concepts and designs of the prior art, and in so doing provides an apparatus primarily developed for the purpose of effecting rotation of a paint roller to clean and condition the roller.

SUMMARY OF THE INVENTION

In view of the foregoing disadvantages inherent in the known types of rotating implements now present in the prior art, the present invention provides a new roller spinning tool construction wherein the same can be utilized for effecting rotation of paint roller within a solvent. As such, the general purpose of the present invention, which will be described subsequently in greater detail, is to provide a new roller spinning tool apparatus and method which has many of the advantages of the rotating implements mentioned heretofore and many novel features that result in a roller spinning tool which is not anticipated, rendered obvious, suggested, or even implied by any of the prior art rotating implements, either alone or in any combination thereof.

To attain this, the present invention generally comprises a tool for effecting rotating of a paint roller to clean and condition the roller. The inventive device includes a handle member for coupling to a brush spinner or for manual rotation between opposed palms of a pair of human hands. A central engaging member extends from the handle member for engaging a center of a roller to permit rotation thereof within a solvent.

There has thus been outlined, rather broadly, the more important features of the invention in order that the detailed description thereof that follows may be better understood, and in order that the present contribution to the art may be better appreciated.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limited.

As such, those skilled in the art will appreciate that the conception, upon which this disclosure is based, may readily be utilized as a basis for the designing of other structures, methods and systems for carrying out the several purposes of the present invention. It is important, therefore, that the claims be regarding as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new roller spinning tool apparatus and method which has many of the advantages of the rotating implements mentioned heretofore and many novel features that result in a roller spinning tool which is not anticipated, rendered obvious, suggested, or even implied by any of the prior art tool guides, either alone or in any combination thereof.

It is another object of the present invention to provide a new roller spinning tool which may be easily and efficiently manufactured and marketed.

It is a further object of the present invention to provide a new roller spinning tool which is of a durable and reliable construction.

An even further object of the present invention is to provide a new roller spinning tool which is susceptible of a low cost of manufacture with regard to both materials and labor, and which accordingly is then susceptible of low prices of sale to the consuming public, thereby making such roller spinning tools economically available to the buying public.

Still yet another object of the present invention is to provide a new roller spinning tool which provides in the apparatuses and methods of the prior art some of the advantages thereof, while simultaneously overcoming some of the disadvantages normally associated therewith.

Still another object of the present invention is to provide a new roller spinning tool for effecting rotating of a paint roller to clean and condition the roller.

Yet another object of the present invention is to provide a new roller spinning tool which includes a handle member for coupling to a brush spinner for manual rotation between opposed palms of a pair of human hands, and a central engaging member extending from the handle member for engaging a center of a roller to permit rotation thereof within a solvent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a roller spinning tool according to the present invention in use.

FIG. 2 is an isometric illustration of the invention, per se.

DESCRIPTION OF THE PREFERRED EMBODIMENT

Figure 3:
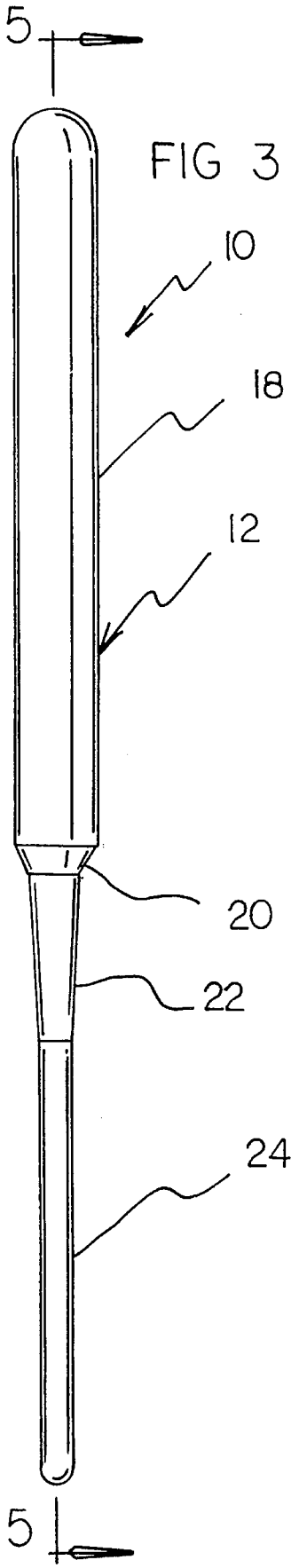
FIG. 3 is an elevation view of the present invention.
Figure 4:
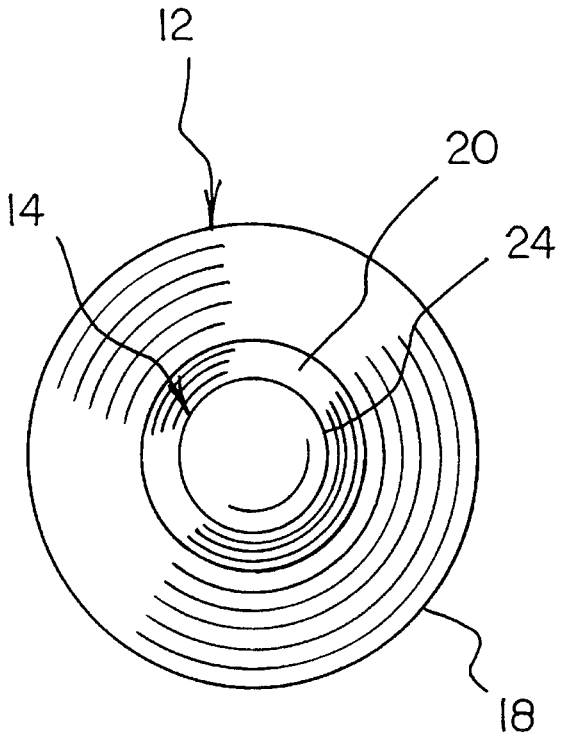
FIG. 4 is a bottom plan view thereof.

With reference now to the drawings, and in particular to FIGS. 1–6 thereof, a new roller spinning embodying the principles and concepts of the present invention and generally designed by the reference numeral 10 will be described.

More specifically, it will be noted that the roller spinning tool 10 comprises a handle means 12 for being rotated through a coupling thereof to a chuck of a brush spinner or power drill. Alternatively, the handle means 12 can be positioned between facing palms of a pair of human hands, whereby relative motion between such hands will effect rotation of the handle means 12, as shown in FIG. 1 of the drawings. A central engaging means 14 extends from the handle means 12 and is axially aligned therewith for engaging a center of a roller 16 to effect rotation of the roller within a solvent such as water to clean and condition the roller 16.

Figure 5:
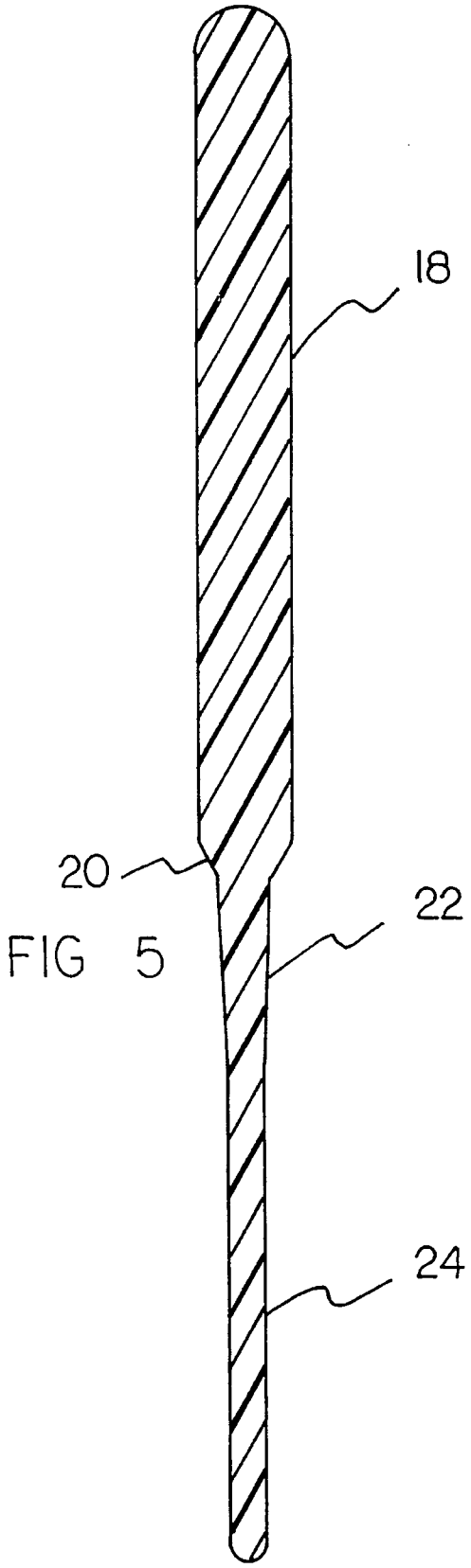
FIG. 5 is a cross sectional view taken along line 5—5 of FIG. 3.

As best illustrated in FIGS. 2 and 5, it can be shown that the handle means 12 according to the present invention 10 preferably comprises an elongated cylindrical handle member 18 having respectively opposed upper and lower ends. The elongated cylindrical handle member 18 is shaped so as to define a cylindrical outer surface having a constant radius of curvature as well as a constant diameter along a longitudinal length thereof to permit placement and rotation between opposed palms of a pair of human hands as shown in FIG. 1 of the drawings. Alternatively, the elongated cylindrical handle member 18 can be inserted into a chuck or other engaging device of a powered brush spinner of power drill, whereby tightening of the chuck or other engaging device will effect coupling of the handle means 12 thereto such that spinning of the handle means 12 by the powered brush spinner or drill can be accomplished.

With continuing reference to FIGS. 2 through 5, it can be shown that the central engaging means 14 preferably comprises a conical neck 20 extending from the lower end of the elongated cylindrical handle member 18 and being coaxially aligned therewith. The conical neck 20 is of a first diameter equal to a diameter of the elongated cylindrical handle member 18 at the lower end thereof, and tapers to a second diameter spaced from the lower end of the elongated cylindrical handle member 18, wherein the first diameter is substantially greater than the second diameter. A tapered gripping cone 22 extends from the conical neck 20 and is coaxially aligned therewith. The tapered gripping cone 22 is of the second diameter at an intersection of the conical neck 20 with the tapered gripping cone, and tapers to a third diameter spaced from the conical neck. The third diameter is substantially less than the second diameter so as to define a tapered conical shape of the gripping cone 22. It should be noted that the conical neck 20 tapers from the first diameter to the second diameter over a first longitudinal length, with the tapered gripping cone 22 tapering from the second diameter to the third diameter over a second longitudinal length, wherein the second longitudinal length is substantially greater than the first longitudinal length. Further, a difference between the first diameter and the second diameter is preferably three times the difference between the second diameter and the third diameter such that a slope of the side wall of the conical neck 20 is substantially greater than a slope of the side wall of the tapered griping cone 22 relative to a longitudinal axis of the device 10. The tapered gripping cone 22 in cooperation with the conical neck 20 thus allows the central engaging means 14 to be frictionally engaged to interior surfaces of rollers 16 of various internal diameters.

The central engaging means 14 still further comprises an elongated cylindrical engaging member 24 projecting in an axially aligned manner from the tapered griping cone 22. The elongated cylindrical engaging member 24 is of the third diameter and is preferably of a constant diameter along a longitudinal length thereof.

Preferably, the entire device is integrally molded from a polymeric material such as plastic or synthetic resin. Alternatively, the present invention 10 may be machined from other material such as wood or metal as desired.

Figure 6:
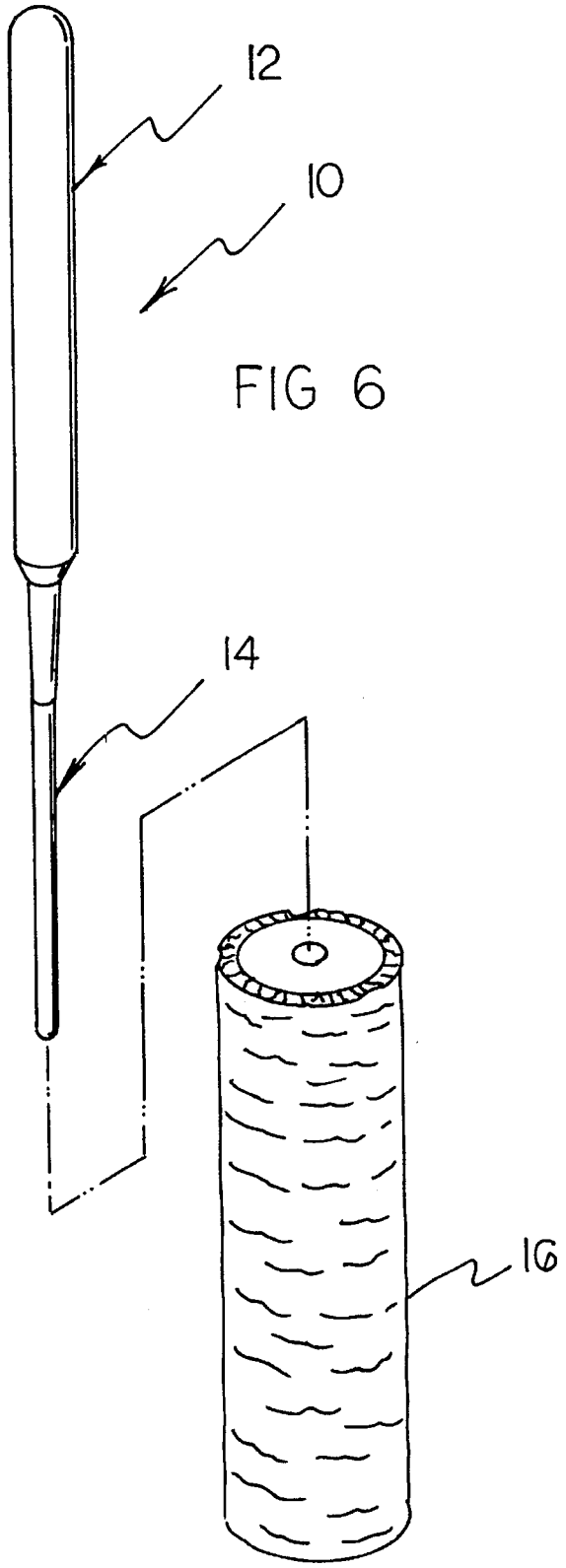
FIG. 6 is an isometric illustration detailing a coupling of the roller spinning tool to a paint roller.

In use, the roller spinning tool 10 according to the present invention can be easily positioned into engagement with a roller 16 as shown in FIG. 6 of the drawings. To this end, the central engaging means 14 can be inserted into a center of the roller 16, whereby a frictional engagement between interior surfaces of the roller 16 and exterior surfaces of the central engaging means 14 results. The handle means 12 can then be manually or otherwise rotated to effect rotation of the roller 16 within a container of solvent as illustrated in FIG. 1 of the drawings. The roller 16 is then cleaned and conditioned by such rotation within the solvent, whereby paint and other debris are substantially removed from an exterior of the roller 16 to restore the roller to a useful condition.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roller spinning tool comprising:

a handle means for being rotated, the handle means comprises an elongated cylindrical handle member having respectively opposed upper and lower ends, the elongated cylindrical handle member being shaped so to define a cylindrical outer surface having a constant radius or curvature as well as a constant diameter along a longitudinal length thereof to permit placement and rotation of the cylindrical handle member between opposed palms of a pair of human hands;

a central engaging means extending from the handle means and being axially aligned therewith for engaging a center of a roller to effect rotation of the roller within a solvent, the central engaging means comprises a conical neck extending from the lower end of the elongated cylindrical handle and being coaxially aligned therewith, the conical neck being of a first diameter equal to a diameter of the elongated cylindrical handle member at the lower end thereof and tapering to a second diameter spaced from the lower end of the elongated cylindrical handle member, wherein the first diameter is substantially greater than the second diameter, the central engaging means further comprises a tapered gripping cone extending from the conical neck and being coaxially aligned therewith, the tapered gripping cone being of the second diameter at an intersection of the conical neck with the tapered gripping cone and tapering to a third diameter spaced from the conical neck, wherein the third diameter is substantially less than the second diameter so as to define a tapered conical shape of the gripping cone, the conical neck tapers from the first diameter to the second diameter over a first longitudinal length, with the tapered gripping cone tapering from the second diameter to the third diameter over a second longitudinal length and a difference between the second longitudinal length is substantially greater than the first longitudinal length and a difference between the first diameter and the second diameter is equal to a difference between the second diameter and the third diameter such that a slope of the side wall of the conical neck is substantially greater than a slope of the side wall of the tapered gripping cone relative to a longitudinal axis of the roller spinning tool, the central engaging means further comprises an elongated cylindrical engaging member projecting in an axially aligned manner from the tapered gripping cone, the elongated cylindrical engaging member being of the third diameter and of a constant diameter along a longitudinal length thereof.

* * * * *